United States Patent [19]

Fletcher et al.

[11] 4,253,920

[45] Mar. 3, 1981

[54] COMPOSITION AND METHOD FOR GOLD PLATING

[75] Inventors: Augustus Fletcher, Bristol; William L. Moriarty, South Meriden, both of Conn.

[73] Assignee: American Chemical & Refining Company, Incorporated, Waterbury, Conn.

[21] Appl. No.: 132,279

[22] Filed: Mar. 20, 1980

[51] Int. Cl.[3] ..... C25D 3/48; C25D 3/62

[52] U.S. Cl. ..... 204/43 G; 204/46 G

[58] Field of Search ..... 204/43 G, 46 G; 106/1.26

[56] References Cited

U.S. PATENT DOCUMENTS

| | | | |
|---|---|---|---|
| 2,660,554 | 11/1950 | Ostrow | 204/43 G |
| 3,672,969 | 6/1972 | Nobel et al. | 204/43 G |
| 3,706,634 | 12/1972 | Kowalski | 204/46 |
| 3,770,596 | 11/1973 | Bick et al. | 204/43 G |
| 3,856,638 | 12/1974 | Bick et al. | 204/43 G |
| 3,870,619 | 3/1975 | Weisberg et al. | 204/43 G |
| 3,904,493 | 9/1975 | Losi et al. | 204/43 G |
| 4,186,064 | 1/1980 | Morrisey | 204/43 G |
| 4,197,172 | 4/1980 | Fletcher et al. | 204/43 G |

*Primary Examiner*—G. L. Kaplan

[57] ABSTRACT

A bath for electroplating hard gold deposits at relatively high current efficiencies comprises an aqueous solution of a phosphate electrolyte, 1-hydroxyethylidene-1,1-diphosphonic acid, metal constituent, alkali metal gold cyanide and a small amount of free alkali metal cyanide. The bath is maintained at a pH of 3.0–13.0 and operated at a current density of 0.1–165 amperes per square decimeter.

17 Claims, No Drawings

COMPOSITION AND METHOD FOR GOLD PLATING

BACKGROUND OF THE INVENTION

Metallic elements such as cobalt and nickel are frequently added to gold plating compositions to increase the hardness of the electrodeposited metal; when composition and plating conditions are closely controlled and contamination is minimized, bright deposits are readily obtained over a satisfactory range of current densities. Unfortunately, contamination with various metals frequently occurs and the stability of the bath is affected significantly; moreover, the current efficiency of the bath may be reduced rapidly.

Phosphonic acid chelating agents have long been proposed as components of gold and other metal plating baths to chelate contaminants such as copper and lead. Moreover, it has been recognized that iron contamination can be minimized in baths using a phosphate electrolyte since the phosphate will react with the iron to produce a precipitate.

Exemplary of the baths containing phosphonic acid chelating agents are U.S. Pat. No. 3,770,596 granted Nov. 6, 1973 to Bick et al.; U.S. Pat. No. 3,672,969 to Nobel et al.; U.S. Pat. No. 3,706,634 granted Dec. 19, 1972 to Kowalski; and U.S. Pat. No. 3,904,493 granted Sept. 9, 1975 to Losi et al. Bick et al. U.S. Pat. No. 3,856,638 granted Dec. 24, 1974 is of interest in proposing that the nickel and cobalt be reacted with a phosphonic acid compound and aminoguanidine.

The use of various other organic compounds as chelating agents, brighteners, levelling agents and the like has long been known, and the patent and technical literature contain many compounds and combinations of compounds proposed to offer various advantages. Moreover, buffering agents such as citric acid, boric acid, malic acid and the like have also been proposed to control the pH of the bath.

Despite the various known combinations of compounds that might be added to a plating bath for electrodepositing a hard gold alloy, it has remained a continuing problem to provide a stable bath which would operate at high current efficiency in a wide range of current densities and without requiring a change in bath makeup. Moreover, the industry desires all purpose baths which can be used for rack, barrel and high speed plating applications with reasonable efficiency.

In copending application for U.S. Pat., Ser. No. 027,364, filed Apr. 5, 1979, and entitled "Plating Composition and Method" (now issued as U.S. Pat. No. 4,197,172), applicants have described novel plating baths which produce hard, bright gold deposits at relatively high current efficiencies, which are able to tolerate reasonable amounts of the conventional metal contaminants, and which may be readily prepared and replenished. They also describe a novel plating method, which is simple, relatively trouble-free and is not critical from the standpoint of operating conditions. Notwithstanding the very significant benefits afforded by the foregoing composition and method, yet further improvements, such as may permit broader applicability and extended ranges of operability are, of course, desirable.

Accordingly, it is an object of the present invention to provide a novel gold plating bath which contains a metal constituent, which is stable and efficient over wide ranges of current density, pH values and temperatures, and especially at high current densities, and which may be used for rack, barrel, strip and other high speed applications.

It is also an object to provide such a bath which may be formulated readily and relatively economically and which is highly effective in resisting the effects of copper, lead and iron contamination.

Another object is to provide a novel and highly efficient method for electrodepositing hard, bright gold alloy deposits over wide ranges of current densities, pH values and temperatures, and in various types of plating applications.

SUMMARY OF THE INVENTION

It has now been found that the foregoing and related objects may be readily attained in a gold plating bath which comprises an aqueous solution containing 15–150 grams per liter of a phosphate electrolyte and 15–150 grams per liter of 1-hydroxyethylidene-1,1-diphosphonic acid. The bath also includes a metal constituent selected from the group consisting of the 1-hydroxyethylidene-1,1-diphosphonic acid chelate of nickel, the 1-hydroxyethylide-1,1-diphosphonic acid chelate of cobalt, soluble indium compounds, soluble thallium compounds, soluble arsenic compounds, and mixtures thereof, and provides 0.002–10.0 grams per liter of the metal calculated as the metal. Alkali metal gold cyanide is present in an amount providing 1–41 grams per liter of gold, calculated as the metal, the free alkali metal cyanide is present in an amount of at least 2.5 percent by weight of the gold metal and sufficient to prevent precipitation of the metal values. The solution has a pH of 3.0–13.0 and a specific gravity of 4°–30° Baume.

It is especially desirable, when the pH is maintained below 7.0, that the metal constituent be selected from the group consisting of the specified constituents of cobalt, nickel and indium, and mixtures of at least two of such constituents. In other embodiments, in which the pH is maintained at 7.0 or higher, the metal constituent will most desirably be selected from the group consisting of the compounds of arsenic and thallium and mixtures thereof, and arsenic is preferred.

In especially preferred plating baths, the phosphate electrolyte will be present in an amount of 40–60 grams per liter, the 1-hydroxyethylidene-1,1-diphosphonic acid will be present in an amount of 40–75 grams per liter, and the metal constituent will provide 0.3–3.0 grams per liter of metal. The bath may advantageously additionally include about 3.0 to 37.5 grams per liter of triethanolamine borate.

In the method of electroplating hard gold deposits upon a workpiece, a workpiece having an electrically conductive surface is immersed in the gold plating bath which is maintained at a temperature of about 20°–85° C. An electrical potential is applied across the workpiece and an anode to provide a current density of about 0.1–165 amperes per square decimeter at the workpiece to effect the desired thickness for the electrodeposit, and the electroplated workpiece is then removed from the bath.

DETAILED DESCRIPTION OF THE PREFERRED EMBODIMENTS

As previously indicated, the baths of the present invention include an alkali metal dihydrogen phosphate, 1-hydroxyethylidene-1,1-diphosphonic acid, a metal hardener and/or brightener, alkali metal gold cyanide and free alkali metal cyanide.

Although any of the conventional phosphate salts or acids may be employed as the primary component of the electrolyte, monopotassium phosphate will be preferred in most instances. The amount of the phosphate salt may range from as little as 15 to as much as 150 grams per liter, with the preferred compositions containing 40–60 grams per liter. The amount required for optimum performance will of course vary with the amounts of the other components. In the present compositions, it will be appreciated that the dihydrogen phosphate salt will serve the dual purpose of providing a part of the electrolyte and of providing buffering of the pH of the bath to maintain it within optimum conditions.

The 1-hydroxyethylidene-1,1-diphosphonic acid similarly may vary from as little as 15 to as much as 150 grams per liter, with the range of 35–75 grams per liter being preferred. Generally, it is desirable that the amount of the 1-hydroxyethylidene-1,1-diphosphonic acid approximate the amount of the phosphate salt in the bath. In the baths of the present invention, the 1-hydroxyethylidene-1,1-diphosphonic acid not only serves as a chelating agent, but also comprises a part of the electrolyte.

In producing the metal constituents of the plating baths, it is important, in most instances, that a suitable procedure be utilized. Failure to do so may, in fact, result in the development of heavy precipitates, rendering the bath involved worthless. In each of the procedures described below, initial admixture of components occurs at ambient temperature; deinionized or distilled water is used.

To produce a nickel or cobalt chelate, a suitable procedure commences with the addition of 300 grams of 1-hydroxyethylidene-1,1-diphosphonic acid to 300 milliliters of water, which is stirred to produce thorough mixing. After heating the mixture to 71° centigrade, 50 grams of the metal carbonate is slowly added, and agitation is maintained until all gassing has ceased, taking care to maintain the pH of the solution between 2.0 and 2.5 by adding more of the diphosphonic acid, as necessary. Thereafter, water is added to adjust the volume of the mixture to one liter; the metal concentration will be 25 grams per liter.

A suitable indium additive is made by dissolving 56.4 grams of anhydrous indium sulphate in 600 milliliters of water. Concentrated sulfuric acid is slowly added to the admixture to adjust the pH to a value of 3.5 to 3.8, following which the volume is brought to a full liter, by the addition of water. The product will also contain 25 grams per liter of the metal.

Thallium and arsenic additives may be prepared simply by dissolving appropriate amounts of a suitable compound in 600 mililiters of water, followed by the addition of sufficient water to produce one liter. In the case of thallium, 2.0 grams of the nitrate salt is used; the arsenic additive is made with 3.5 grams of sodium arsenite. The foregoing mixtures will contain 1.53 grams per liter of thallium and 2.0 grams per liter of arsenic, respectively, as the metals.

Notwithstanding the foregoing specification of compounds, other substances can be employed to produce the several additives. In the case of nickel and cobalt, the phosphate, citrate or sulfate salts may be reacted with the 1-hydroxyethylidene-1,1-diphosphonic acid compound. Indium nitrate may be substituted for the sulfate salt, and potassium arsenite or (at alkaline pH values) arsenic trioxide may be used in place of sodium salt specified. In the case of the chelated additives, it is important that, while in a concentrated form, the pH be maintained on the acid side; otherwise, precipitation will tend to occur.

When used, the triethanolamine borate may range from as little as 3.0 grams per liter to as much as 37.5 grams per liter, with the preferred range being 5 to 15 grams per liter. The manner in which this component functions is not fully understood, but it is seen to produce a significant benefit in current efficiency, particularly in the low and medium current density areas; at values of 2 ASD and above, little or no benefit will generally be realized.

Although the alkali metal gold cyanide may provide as little as 1 gram per liter of gold to as much as 41 grams per liter, the preferred compositions contain the gold metal within the range of 2.5 to 15 grams per liter. Depending upon the acidity of the bath, it may be necessary to add free alkali metal cyanide in order to provide stability, possibly because of a tendency for the other metals to compete for the complexing cyanide ions. In any event, the amount of the free alkali metal cyanide present should be at least 0.05 gram per liter, and preferably at least 0.25 gram per liter, so as to prevent precipitation of the essential metals in the bath. Amounts of free cyanide in excess of about 3.75 grams per liter tend to result in some evolution of hydrogen cyanide gas in the acid baths, and that quantity therefor represents a practical upper limit, in such cases. To ensure optimum stability, any free alkali metal cyanide added is desirably introduced to the alkali metal gold cyanide solution before its admixture with the remaining components.

As previously indicated, operating conditions using the baths of the present invention may vary fairly widely, with temperatures of 20°–85° C. being usable; preferred conditions favor a temperature of 35°–50° C. The current density may vary from 0.1–165 amperes per square decimeter. However, in acid baths the preferred combination of optimum deposit and high current efficiency will generally be obtained at 0.5–5.0 amperes per square decimeter; similarly, in neutral and alkaline baths, optimal results will generally be realized at current densities of 0.3 to 1.0 ampere per square decimeter.

The pH of the composition may be maintained in the broad range of 3.0 to 13.0; however, depending upon the properties desired in the deposit produced and the components of the bath, more limited pH values will generally produce the best results. Thus, when the metal constituent is of cobalt, nickel, indium and mixtures thereof, acid pH values will normally be maintained, and pH values of neutral and above will generally produce optimal results when the bath contains arsenic and/or thallium; nevertheless, cobalt, nickel and indium may be used in neutral and alkaline baths, and arsenic and thallium may be used in baths that are acidic. Also, while any combination of the specified metal additives may be employed, on the one hand, cobalt, nickel and indium will generally be used together; arsenic and thallium will, on the other hand, usually be combined with one another, if at all.

Various plating apparatus may be employed for the compositions and methods of the present invention, including barrel and rack plating equipment, and high speed continuous selective plating equipment. Moreover, in addition to the conventional steady direct current plating, pulse plating can be employed to produce good, non-porous deposits at relatively high speed with the least amount of gold content, if the metal constituent concentration is proportionately reduced. In such operations, the average and peak current densitites applied will generally range to about 16.2 and 162 amperes per square decimeter, respectively, with good results.

Various anodes may be employed including gold, stainless steel, platinum, platinum-clad tantalum and graphite. The material from which the tank or other vessel is fabricated should be inert to the bath, and polypropylene, rubber lined steel, polyvinylchloride or other suitable materials are desirably employed. The bath should be filtered and agitated during operation to avoid difficulties and to obtain optimum operation.

Exemplary of the efficacy of the present invention are the following specific examples wherein all parts are parts by weight unless otherwise indicated. Hardnesses are expressed as Knoop hardness values, and represent the average of a number of tests using a 25 gram indenting tool. As used in the following examples, 1-hydroxyethylidene-1,1-diphosphonic acid is a product sold by Monsanto Company under the designation DEQUEST 2010.

EXAMPLE ONE

A starter bath is prepared having the following composition:

| Component | Amount |
|---|---|
| Monopotassium phosphate | 60 g. |
| 1-hydroxyethylidene-1,1-diphosphonic acid | 42 ml |
| Cobalt chelate (as metal) | 0.35 g. |
| Gold (as metal) [introduced as $KAu(CN)_2$] | 8.2 g. |
| Deionized water | to 1000 ml |

The cobalt chelate is the 1-hydroxyethylidene-1,1-diphosphonic acid reaction product prepared as described hereinabove. The pH of the composition is adjusted to 4.2 with potassium hydroxide, and the bath is found to have a specific gravity is 12° Baume at ambient temperature. An aliquot of the composition is modified by adding thereto 8.2 grams per liter of triethanolamine borate.

Part A

The two baths are maintained at a temperature of 50° C. in a standard Hull Cell, and a series of Hull Cell panels are plated using a platinized tantalum anode under varying conditions, which conditions, together with the results observed, are set forth below.

| Sample | Amp. | Time,min | Efficiency | Borate | Bright Range |
|---|---|---|---|---|---|
| 1 | 0.5 | 2.0 | 56.7 mg/AM | No | 0–2 ASD |
| 2 | 0.5 | 2.0 | 67.9 mg/AM | Yes | 0–1 ASD |
| 3 | 2.0 | 0.5 | 46.0 mg/AM | No | 0–4.3 ASD |
| 4 | 2.0 | 0.5 | 34.1 mg/AM | Yes | 0–2.7 ASD |

From the foretoing data, it can be observed that the inclusion of the triethanolamine borate compound increases efficiency (expressed in milligrams per ampere-minute) at low current density levels, and causes a decrease of efficiency at high levels. Accordingly, use of the bath at current densities up to about 2 ASD would produce high deposition rates with the triethanolamine borate compound; however, the additive would be expected to be of little benefit in high speeed plating operations.

Part B

A series of tests are performed in a high speed cell, utilizing apparatus of the sort described in U.S. Pat. No. 4,102,770, under the following conditions:

1. A nickel strip plated with a gold strike is pulse plated for one minute at temperatures of about 44°, 46° and 49° centigrade, applying a current of 20 amperes, with a cycle of one millisecond on and 9 milliseconds off, to produce an average applied current of 2 amperes and average and peak current density values of about 16.2 ASD and about 162 ASD, respectively. The strip is moved at a rate equivalent to about 20 linear feet per minute. A semi-bright, non-porous deposit is produced, with efficiency values of 44.1 mg/AM at 44° centigrade, 37.63 mg/AM at 46°, and 42.8 mg/AM at 49°, respectively.

2. Repeating the foregoing run at 44° centigrade, but using straight (non-pulsating) direct current at 2 amperes, produces a semi-bright deposit with an efficiency of 54.1 mg/AM.

3. Using the same cycle and current conditions of section 1 of this Example, the strip is plated for 10 minutes from a bath maintained at a temperature of 49° centigrade. Plating efficiency is 39.61 mg/AM, and the deposit is analyzed (by difference) to be 99.8222 percent pure gold, the remainder being 0.0073 percent copper, 0.0065 percent iron, 0.004 percent nickel and 0.16 percent cobalt; it exhibits a Knoop hardness value of 151.5.

4. The same bath is used, at the same temperature, to plate strip for one minute, but applying a current of 5.5 amperes during a 0.6 millisecond on, 1.0 millisecond off, cycle to provide a 2.0 ampere average current and average and peak current densities of 16.2 ASD and 40.5 ASD, respectively. A semi-bright deposit is produced, with an efficiency of 45.3 mg/AM.

5. To evaluate the capacity of the bath to chelate copper, 0.03 gram per liter of copper is added (as the potassium cyanide complex), and the bath is used at 49° centigrade to pulse plate a gold strike plated strip under the current conditions described in section 1 of this Part. The depost is semi-bright, and efficiency is at a value of 37.0 mg/AM; upon analysis, the bath is found to contain 0.004 gram of copper. The same bath, contaminated with an additional 0.03 gram per liter of copper, is again run for 1 minute under the same conditions; the deposit is semi-bright, and efficiency is reduced only slightly, to a value of 36.4 mg/AM. Plating under the same conditions for 10 minutes produces a bright deposit determined (by difference) to be 99.7767 percent pure gold; (the deposit is analyzed and found to contain 0.049 percent copper, 0.0064 percent nickel, 0.16 percent cobalt and 0.0079 percent iron), with a hardness of 134.5.

EXAMPLE TWO

A one liter bath is prepared having the same composition as that described in Example One, but using 25 milliliters of the 1-hydroxyethylidene-1,1-diphosphonic acid, and substituting nickel as a complex with the 1-hydroxyethylidene-1,1-diphosphonic acid (providing 0.992 gram of the metal) for the cobalt complex employed therein; the pH of the bath, formulated at a temperature about 50° centigrade, is 3.9.

Part A

1. Utilizing the foregoing bath, a Hull Cell test is run at a current of 0.5 ampere for a period of two minutes. It produces a deposit which is bright over a current density range extending to somewhat more than 2 ASD. The plating efficiency is 38.7 mg/AM.

2. The pH of the bath described hereinabove is adjusted to a value of 5.8 with potassium hydroxide. Again in a Hull Cell test conducted for two minutes with an applied current of 0.5 ampere, the bath produces a brightness range of about 0–0.9 ASD; efficiency is 110.7 mg/AM.

3. To the bath of section 2 is added a sufficient amount of 1-hydroxyethylidene-1,1-diphosphonic acid to reduce the pH to 4.0. As a result, a bright deposit is produced at a range of 0 to about 1 ASD with an efficiency of 88.6 mg/AM, under the same conditions of operation.

4. The bath of section 1 of this Part is utilized to plate a polished brass panel at a current density of about 1.2 ASD for 88 minutes. A bright deposit is produced over the entire panel, except in areas of extremely high current density, where some dullness occurs, apparently due to the deposition of nickel; the efficiency of plating is 32.1 mg/AM.

Part B

To the bath described in section 1 of Part A of this Example the cobalt chelate of Example One is added in an amount sufficient to provide about 0.5 gram per liter of cobalt to the bath; thus, both the nickel and also the cobalt complexes are present.

1. In a Hull Cell test at 0.5 ampere for two minutes, with the bath at a temperature of about 38° centigrade, a bright deposit is produced over a range of 0 to about 2 ASD; eficiency is 49.8 mg/AM.

2. Adjusting the temperature of the bath of section 1 to about 50° centigrade produces brightness over substantially the same range, with a plating efficiency of 41.2 mg/AM.

3. Utilizing the bath of section 1 to plate a polished brass panel at about 1 ASD for 8 minutes and a temperature of about 48° centigrade produces a deposit which is bright and uniform over substantially the entire area of the panel.

4. To the bath of section 1 is added indium sulfate in an amount sufficient to provide about 0.25 gram per liter of the metal. Plating in a Hull Cell at 0.5 ampere for two minutes and a temperature of 48° centigrade produces 33.9 mg/AM of gold deposit, which is bright over a range of 0 to about 2 ASD.

5. The bath of section 4 is used to plate a polished brass panel for 10 minutes at a current density of about 1.6 ASD at the same temperature. The deposit is bright and uniform, and efficiency is determined to be 34.8 mg/AM.

6. The run of section 5 is repeated with a current density of about 2 ASD. While otherwise bright and uniform, burning of the panel is evidenced in areas of highest current density.

7. Under the conditions of section 6, a polished brass panel is plated to a thickness of 1000 microinches, and the composition of the deposit is analyzed. It is found to contain percentages of the metals as follows: 95.45 gold, 3.7 nickel, 0.8 cobalt and 0.03 indium. The bath is analyzed to contain, in grams per liter, 3.936 gold, 0.886 nickel. 0.433 cobalt and 0.119 indium.

8. To a bath having the composition in section 4 is added sufficient additional nickel, as a complex with the 1-hydroxyethylidene-1,1-diphosphonic acid, to adjust the total concentration of nickel to 1.0 gram per liter. Plating a polished brass panel in the bath at about 50° centigrade for a period of 5 minutes, with an applied current sufficient to produce a current density of about 1 ASD, produces a deposit which is uniform and bright; efficiency is found to be 25.3 mg/AM.

9. A second brass panel is plated in the bath of section 8, adjusted to a pH of 3.9. The panel is again brightly and uniformly plated; efficiency is 29.52 mg/AM.

10. To the bath of section 9 is added a sufficient amount of the nickel chelate to produce a total concentration of 1.54 grams per liter of the metal. Plating in a Hull Cell with an applied current of 0.5 ampere for a period of two minutes produces a deposit which is bright over a range of 0 to about 2 ASD, with an efficiency of 24.7 mg/AM.

11. Using the bath of section 10, a tantalum strip is plated for 2.5 hours at a current density of about 1 ASD and a temperature of 35° centigrade. The efficiency is 30.37 mg/AM, and the deposit is analyzed to contain metals in the following percentages: 98.71 gold, 1.2 nickel, 0.3 cobalt and 0.004 indium (the excess of 0.2 percent being attributable, apparently, to error of the analytical equipment used); the deposit is 23.7 Karat gold.

12. The same bath is again used to plate a polished brass panel for a period of 5 minutes under the same temperature and conditions. The deposit is bright and uniform.

13. In a Hull Cell, the same bath is used at 35° centigrade to plate for two minutes with an applied current of 0.5 ampere. A bright deposit is produced at current densities up to about 2 ASD, and efficiency is 27.6 mg/AM.

EXAMPLE THREE

An electroplating bath is formulated with the same composition as described in Example Two, except that the amount of nickel/phosphonic acid chelate utilized is 1.61 grams per liter (as metal); its pH is 4.0.

Part A

1. A polished brass panel is plated in the above bath, at a temperature of about 46° centigrade for a period of five minutes at a current density of about 1 ASD. A bright and uniform deposit is produced on the panel, with an efficiency of 45.95 mg/AM.

2. In the same bath at the same temperature and under the same current conditions, a second polished brass panel is plated for two hours, and the resultant deposit is tested for hardness; it is found to have a value of 195.

Part B

1. The bath of Part A is analyzed, and found to contain 5.658 grams per liter of gold and 1.49 grams per liter of nickel. The concentration of gold is adjusted, by the addition of potassium cyanide gold complex, to provide a concentration 8.2 grams per liter. Using the bath at a temperature of about 47° centigrade, a polished brass panel is plated at about 1 ASD for 5 minutes; the deposit is uniform and bright and efficiency is 27.76 mg/AM.

2. Utilizing the same bath at a pH of 3.9 and under the same operating conditions, a second brass panel is plated for a period of 2 hours. The deposit produced contains 98.02 percent gold and 1.98 percent nickel.

Part C

1. The bath of Part B hereof is analyzed, and additives are introduced (on a grams per liter basis) as follows: 3.315 of gold (as 66 percent potassium cyanide gold complex); 11.0 nickel (as the complex); and 9.7 cobalt (as the complex). Plating a polished brass panel in the resultant bath for 5 minutes at about 47° centigrade and at a current density of about 1 ASD produces a bright and uniform deposit, with an efficiency of 26.8 mg/AM.

2. Using the same bath under the same conditions to plate a second polished brass panel for three hours produces a deposit having a Knoop hardness of 200. The composition of the deposit, in percentages, is 96.28 gold, 2.69 nickel and 1.03 cobalt; the bath contains (per liter) 5.986 grams of gold, 1.32 grams of nickle and 0.758 gram of cobalt.

Part D

To the bath of Part C is added a quantity of indium sulfate sufficient to provide a concentration of 0.125 gram per liter of indium (as the metal). It also contains 6.888 grams per liter of gold, 1.49 grams per liter of nickel and 0.957 gram per liter of cobalt (the increases from the foregoing Part apparently being due to evaporation). A polished brass panel plated in the bath at a temperature of about 37° centigrade for a period of 10 minutes, at a density of about 1 ASD, produces a deposit on the panel which is bright and uniform; the efficiency of plate is 34.88 mg/AM.

EXAMPLE FOUR

A bath is formulated with the same composition as that described in the foregoing Example, with the exception that the nickel/phosphonic acid chelate is introduced in an amount of 62 milligrams per liter of solution. The pH of the bath is 3.8, and it has a specific gravity of 13° Baume.

Part A

Plating is effected in a Hull Cell using the above bath at a temperature of about 38° centigrade for a period of 2 minutes with an applied current of 0.5 ampere. The deposit is bright over a range of 0 to about 2 ASD, and its efficiency is 26.9 mg/AM. Upon analysis, the bath is found to contain 2.624 grams per liter of gold and 1.03 grams per liter of nickel.

Part B

To the bath of Part A is added 1.0 gram per liter of cobalt (metal) as cobalt/1-hydroxyethylidene-1,1-diphosphonic acid. Plating is carried out for two minutes in a Hull Cell at about 37° centigrade, with a current of 0.5 ampere applied. The deposit is produced with an efficiency of 23.9 mg/AM and exhibits a range of brightness of 0 to about 2 ASD. The bath is analyzed to contain 2.296 grams per liter of gold, 0.966 gram per liter of nickel and 0.901 gram per liter of cobalt.

Part C

Indium sulfate is dissolved in the bath of Part B, and the resultant bath is utilized in a Hull Cell operated at about 35° centigrade for two minutes with an appied current of 0.5 ampere. The deposit is bright over a range of about 2 ASD, and plating efficiency is 22.1 mg/AM. Upon analysis, the bath is found to contain 2.542 grams per liter of gold, 0.875 gram per liter of nickel, 0.843 gram per liter of cobalt and 0.122 gram per liter of indium.

Part D

To one liter of the bath of Part C is added 3 grams of 68 percent potassium cyanide gold complex, and the resulting solution is used in a Hull Cell at 35° centigrade, to plate with an applied current of 0.5 ampere for two minutes. The deposit is bright over the range of 0 to about 2 ASD, and plating efficiency is 38.5 mg/AM. The concentration of gold in the bath is 4.756 grams per liter.

Part E

An additional quantity of 68 percent potassium gold cyanide complex, amounting to 3 grams per liter, is introduced into the bath of Part D, which is then used in a Hull Cell under the same operating conditions described in that Part. Again, the range of bright deposits extends to about 2 ASD; the efficiency is increased to 60.0 mg/AM.

Part F

To the bath of Part E is added 34 milliliters of nickel/1-hydroxyethylidene-1,1-diphosphonic acid complex, which is then run under the same conditions as are used in parts C-E of this Example. The range of brightness extends to about 2 ASD, and efficiency is 31.5 mg/AM.

Part G

1. The bath of Part F is further modified by the introduction of 20 milliliters of the cobalt/1-hydroxyethylidene-1,1-diphosphonic acid complex, and is run in a Hull Cell under the same conditions. The range of brightness is maintained at 0 to about 2 ASD, with an efficiency of 30.0 mg/AM. Upon analysis, the bath is found to contain 7.544 grams per liter of gold, 1.39 grams per liter of nickel, 1.36 grams per liter of cobalt, and 0.169 gram per liter of indium.

2. The bath of the foregoing section is used to electroplate a polished brass panel for a period of 97 minutes, with a current density of about 1 ASD. The deposit produced is 23.7 Karat gold; it contains, on a percentage basis, 98.55 gold, 1.03 nickel, 0.40 cobalt and 0.015 indium.

EXAMPLE FIVE

A two liter bath is formulated utilizing 60 grams of monopotassium phosphate, 12.5 milliliters of 1-hydroxyethylidene-1,1-diphosphonic acid, 1.15 grams of nickel (introduced as nickel/1-hydroxyethylidene-1,1-diphosphonic acid complex), and 12.42 grams of 66 percent potassium gold cyanide complex. The temperature of the bath is about 50° centigrade and its pH is adjusted with potassium hydroxide to 3.8. A first polished brass panel plated in the bath at about 1 ASD for 5 minutes has a bright and uniform deposit, and a plating efficiency of 27.1 mg/AM is realized. Plating of a second brass panel at the same current density for 83 minutes produces a deposit having a Knoop hardness of 215.

EXAMPLE SIX

A bath is made-up to contain 60 grams per liter of monopotassium phosphate, 60 milliliters per liter of phosphoric acid, 16.6 milliliters per liter of nickel (metal) as a complex with 1-hydroxyethylidene-1,1-diphosphonic acid, and 12.42 grams of percent potassium gold cyanide complex. The pH of the bath is adjusted to 4.0 with potassium hydroxide, and it is found to have a Baume specific gravity of 18°. Notwithstanding that the bath is operative to produce bright deposits under certain conditions, in the absence of the specified concentration of 1-hydroxyethylidene-1,1-diphosphonic acid the results achieved are significantly less desirable than are realized utilizing the baths of the invention. Thus, both the brightness range and also the range of operative current densities are reduced in the absence of 1-hydroxyethylidene-1,1-diphosphonic acid. Moreover, because of a tendency to form precipitates after relatively short periods of time, the bath of this Example is unacceptably lacking in stability.

EXAMPLE SEVEN

A starter bath is prepared having the following composition:

| Component | Amount |
|---|---|
| Monopotassium phosphate | 65.6 g. |
| 1-hydroxyethylidene-1,1-diphosphonic acid | 50.2 ml |
| Potassium hydroxide | to pH 7.0 |
| Arsenic (as metal) | 0.02 g. |
| Deionized water | to 1000 ml |

Part A

A series of Hull Cell panels are plated utilizing a platinized tantalum anode at the indicated conditions, with potassium gold cyanide added to provide the indicated concentrations of gold, and with the indicated results.

| No. | Temp. | Amp. | Time, Min. | Gold Conc. | Efficiency | Bright Range |
|---|---|---|---|---|---|---|
| 1 | 60° | 0.5 | 2 | 8.2g/l | — | 0.3 ASD |
| 2 | 60° | 0.5 | 2 | 12.3g/l | 116.9 mg/AM | 0.8 ASD |
| 3 | 66° | 0.5 | 2 | 12.3g/l | 116.0 mg/AM | 0.6 ASD |

A second series of tests are performed in a one liter bath of the same composition (12.3 g/l gold), using a Kovar base integrated circuit material, with the indicated results:

| No. | ASD | Time, Min. | A-M | Heat Test Temp. | Heat Test Time | Result |
|---|---|---|---|---|---|---|
| 4 | 1.0 | 4.4 | 2.1 | 450° C. | 5 min. | Slight Discoloration |
| 5 | 0.5 | 9.52 | 2.1 | 450° C. | 5 min. | Bright and Uniform |
| 6 | 0.3 | 15.9 | 2.1 | 450° C. | 5 min. | Bright and Uniform |

In the foregoing table, the Heat Test referred to is that which is normally used in the semi-conductor industry, and entails exposing the deposit in air for a period of time and at an elevated temperature (i.e., 5 minutes and 450° centigrade, in this instance) to determine what changes are produced.

The foregoing bath produces, at a temperature of about 49° centigrade and a current density of 0.5 ASD, with moderate to vigorous agitation, a columnar deposit of 99.95 percent gold having a maximum grain feature size of 3.3 microns and a Knoop hardness of 89; efficiency is 115 mg/AM under those conditions. The bath has application in the semiconductor industry in general, and in the printed circuit, connector and general electronics field, in which gold is deposited upon base metals such Kovar, alloy 42, nickel and gold-plated copper and copper alloys. Because of the high levelling effect that the arsenic is found to have in conjunction with the basic electrolyte, high allowable current densities can be used, with consequential increases in production rates; the time to produce a given thickness may be reduced by as much as 40 percent, compared to conventional practices. It will be appreciated that the ability to produce a deposit which is bright and uniform, and which remains so following heat treatment under the conditions set forth in the foregoing table, is indeed a significant accomplishment.

Part B

The bath of Part A (12.3 g/l gold) is modified by substituting half of its arsenic content with the same weight of thallium; comparable results are achieved in the tests described.

Part C

Thallium is substituted for the arsenic used in Part A (12.3 g/l gold), on an equal weight (of metal) basis. Again, carrying out the tests described produces similar results.

Thus, it can be seen that the present invention provides a novel gold plating bath which contains a metal constituent, which is stable and efficient over wide ranges of current density, pH values and temperatures, and which may be used for rack, barrel, strip, and other high speed applications. It is especially notable that the bath is stable and efficient at high current densities, and is therefore well suited for pulse plating operations. The bath may be formulated readily and relatively economically, and it is highly effective in resisting the effects of copper, lead and iron contamination. The invention also provides a novel and highly efficient method for electrodepositing hard, bright gold alloy deposits over wide ranges of current density, pH values and temperatures, and in various types of plating applications.

Having thus described the invention, we claim:

1. A gold plating bath comprising an aqueous solution of:
   - A. 15–150 grams per liter of a phosphate electrolyte;
   - B. 15–150 grams per liter of 1-hydroxyethylidene-1,1-diphosphonic acid;
   - C. a metal constitutent selected from the group consisting of (i) the 1-hydroxyethylidene-1,1-diphosphonic acid chelates of nickel and cobalt, and (ii) soluble compounds of indium, arsenic, and thallium, and (iii) mixtures thereof, said constituent providing 0.002–10.0 grams per liter of metal calculated as the metal;
   - D. alkali metal gold cyanide in an amount providing 1–41 grams per liter of gold calculated as the metal; and
   - E. free alkali metal cyanide in an amount equal to at least 2.5 percent by weight of the gold metal and sufficient to prevent precipitation of the metal values, said solution having a pH of 3.0–13.0 and a specific gravity of 4°–30° Baume.

2. The bath of claim 1 wherein said pH is below 7.0.

3. The bath of claim 2 wherein said metal constituent is selected from the group consisting of said cobalt and nickel chelates, indium compounds, and mixtures of at least two of said constituents.

4. The bath of claim 1 wherein said pH is at least 7.0, and wherein said metal constituent is selected from said compounds of arsenic, thallium and mixtures thereof.

5. The bath of claim 4 wherein said metal constitutent is an arsenic compound.

6. The bath of claim 1 wherein said phosphate electrolyte is present in the amount of 40–60 grams per liter, said 1-hydroxyethylidene-1,1-diphosphonic acid is present in the amount of 40–75 grams per liter, and said metal constituent provides the metal in the amountof 0.3–3.0 grams per liter.

7. The bath of claim 1 additionally including about 3.0 to 37.5 grams per liter of triethanolamine borate.

8. In a method of electroplating hard gold deposits upon a workpiece, the steps comprising:

A. immersing a workpiece having an electrically conductive surface in a gold plating bath comprising an aqueous solution of:
   1. 15–150 grams per liter of a phosphate electrolyte;
   2. 15–150 grams per liter of 1-hydroxyethylidene-1,1-diphosphonic acid;
   3. a metal constitutent selected from the group consisting of (i) the 1-hydroxyethylidene-1,1-diphosphonic acid chelates of nickel and cobalt, (ii) soluble compounds of indium, arsenic, and thallium, and (iii) mixtures thereof, said constituent providing 0.002–10.0 grams per liter of metal calculated as the metal;
   4. alkali metal gold cyanide in an amount providing 1–41 grams per liter of gold calculated as the metal; and
   5. free alkali metal cyanide in an amount equal to at least 2.5 percent by weight of the gold metal and sufficient to prevent precipitation of the metal values, said solution having a pH of 3.0–13.0 and a specific gravity of 4°–30° Baume.

B. maintaining the temperature of said bath at about 20°–85° C.;

C. applying an electrical potential across said workpiece and an anode to provide a current density of about 0.1–165 amperes per square decimeter at said workpiece to effect the desired thickness for the electrodeposit; and D. removing the electroplated workpiece from said bath.

9. The method of claim 8 wherein said pH is below 7.

10. The method of claim 9 wherein said metal constituent is selected from the group consisting of said cobalt and nickel chelates, indium compounds, and mixtures of at least two of said constituents.

11. The method of claim 9 wherein said current density is 0.5 to 5.0 amperes per square decimeter.

12. The method of claim 9 wherein said method is effected with a pulsating current, and wherein the average and peak current densities applied are up to about 16.2 and 162 amperes per square decimeter, respectively.

13. The method of claim 8 wherein said pH is at least 7.0, and wherein said metal constituent is selected from said compounds of arsenic, thallium and mixtures thereof.

14. The method of claim 13 wherein said metal constituent is an arsenic compound.

15. The method of claim 13 wherein the current density is 0.3 to 1.0 amperes per square decimeter.

16. The method of claim 8 wherein said phosphate electrolyte is present in the amount of 40–60 grams per liter, said 1-hydroxyethylidene-1,1-diphosphonic acid is present in the amount of 40–75 grams per liter, and said metal constituent provides the metal in the amount of 0.3–3.0 grams per liter.

17. The method of claim 8 additionally including about 3.0 to 37.5 grams per liter of triethanolamine borate.

* * * * *